US005860298A

United States Patent [19]

Chen

[11] Patent Number: 5,860,298

[45] Date of Patent: Jan. 19, 1999

[54] THREAD FEEDER WITH THREAD-TWISTING PREVENTIVE DEVICE FOR KNITTING MACHINES

[75] Inventor: Michelle H. R. Chen, Taipei, Taiwan

[73] Assignee: Jen Hui Chen, Taipei, Taiwan

[21] Appl. No.: 862,617

[22] Filed: May 23, 1997

[51] Int. Cl.[6] ..... D04B 15/48; B65H 51/20

[52] U.S. Cl. ..... 66/132 T; 66/132 R; 242/47.01

[58] Field of Search ..... 66/132 Z, 132 T; 242/47.01, 615–615.02

[56] References Cited

U.S. PATENT DOCUMENTS

| | | | |
|---|---|---|---|
| 4,059,240 | 11/1977 | Laursen | 242/47.01 |
| 4,092,006 | 5/1978 | Jacobsson | 242/47.01 |
| 4,434,609 | 3/1984 | Schacht | 242/47.01 X |
| 4,662,575 | 5/1987 | Fecker | 242/47.01 |
| 4,676,442 | 6/1987 | Tholander et al. | 242/47.01 |
| 4,681,272 | 7/1987 | Brunner et al. | 242/47.01 |
| 4,708,299 | 11/1987 | Sarfati | 242/47.01 |
| 5,489,068 | 2/1996 | Vischiani | 242/47.01 |
| 5,546,994 | 8/1996 | Sarfati | 242/47.01 X |
| 5,553,641 | 9/1996 | Zenoni | 242/47.01 X |

*Primary Examiner*—John J. Calvert
*Attorney, Agent, or Firm*—Bacon & Thomas

[57] ABSTRACT

A thread feeder with a thread-twisting preventive device for a knitting machine is provided. The thread-twisting preventive device includes at least a protective piece which is substantially cup-shaped having a wall and a coupling hole. The coupling hole allows the cup-shaped protective piece to be axially coupled to the spinning axis on the thread feeder, thus allowing the wall of the cup-shaped protective device to surround the spinning axis. Since the protective piece is a fixed piece that covers the exposed part of the spinning axis, broken threads will not be pulled by the spinning axis and twisted around the same. Production of fabrics thus will not be delayed due to broken threads twisting around spinning parts of the knitting machine.

3 Claims, 3 Drawing Sheets

THREAD FEEDER WITH THREAD-TWISTING PREVENTIVE DEVICE FOR KNITTING MACHINES

BACKGROUND OF THE INVENTION

1. Field of the Invention

This invention relates to thread feeders for knitting machines, and more particularly, to a thread feeder having a feeding wheel capping with a thread-twisting preventive device to prevent broken threads from being pulled by and twisted around spinning parts of the thread feeder.

2. Description of Related Art

In knitting machines, a thread feeder is used to supply threads from a spool to the needles knitting a fabric. The smooth feeding of the threads is usually a primary consideration in designing the thread feeder. During the knitting process, however, the threads may break off due to various reasons. Once this happens, the broken threads could be pulled by and twisted around spinning parts of the thread feeder in a messy mass.

This problem is depicted in more details in the following with reference to FIG. 3. The conventional thread feeder shown in FIG. 3 includes a thread feeding wheel W on the bottom and a pulley set on the top. The bottom of the thread feeding wheel W is separated from the frame of the thread feeder by a space S, and the top the pulley set is separated from the same by a space of S1, as illustrated in FIG. 3.

If the thread breaks off at a point near the thread feeding wheel and yarn braking means P, the top portion of the broken thread, since it is still being rolled forwards, could be pulled by the exposed portions of the spinning axis in the neck portion N of the thread feeding wheel W as wall as in the neck portion N1 of the pulley set, and thus twisted around the same in a messy mass that could force the knitting machine to stop operation. Since the spaces S, S1 are very narrow in dimension, the twisted threads therein are very difficult to clear away. When doing the clearing, the knitting machine should be temporarily stopped, which will significantly affect the schedule of the production process.

In view of the foregoing problem in conventional knitting machines, there exists, therefore, a need for an improved thread feeder which is capable of preventing broken threads from being pulled by and twisted around spinning parts of the knitting machine such that the knitting machine will not be forced to stop for a long while so as to clear away the twisted mess of the broken threads.

SUMMARY OF THE INVENTION

It is therefore a primary objective of the present invention to provide a thread feeder with a thread-twisting preventive device which is capable of preventing broken threads from being pulled by and twisted around any spinning parts of thread feeder for the knitting machine.

In accordance with the foregoing and other objectives of the present invention, a new and improved thread feeder with a thread-twisting preventive device is provided. The thread feeder is mounted on a knitting machine of the type having at least a thread feeding wheel coupled by means of a spinning axis on the frame body of the thread feeder.

The thread-twisting preventive device includes at least a protective device which is substantially cup-shaped having a wall and a coupling hole. The coupling hole allows the cup-shaped protective device to be axially coupled to the spinning axis on the thread feeder, thus allowing the wall of the cup-shaped protective device to surround the spinning axis. This shields the spinning axis from the intrusion of any foreign objects including broken threads.

Since the protective device is a fixed piece that covers the exposed part of the spinning axis, broken threads will not be pulled by the spinning axis and twisted around the same. Production of fabrics thus will not be delayed due to broken threads twisting around spinning parts of the thread feeder as in the prior art.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENT

Figure 1:
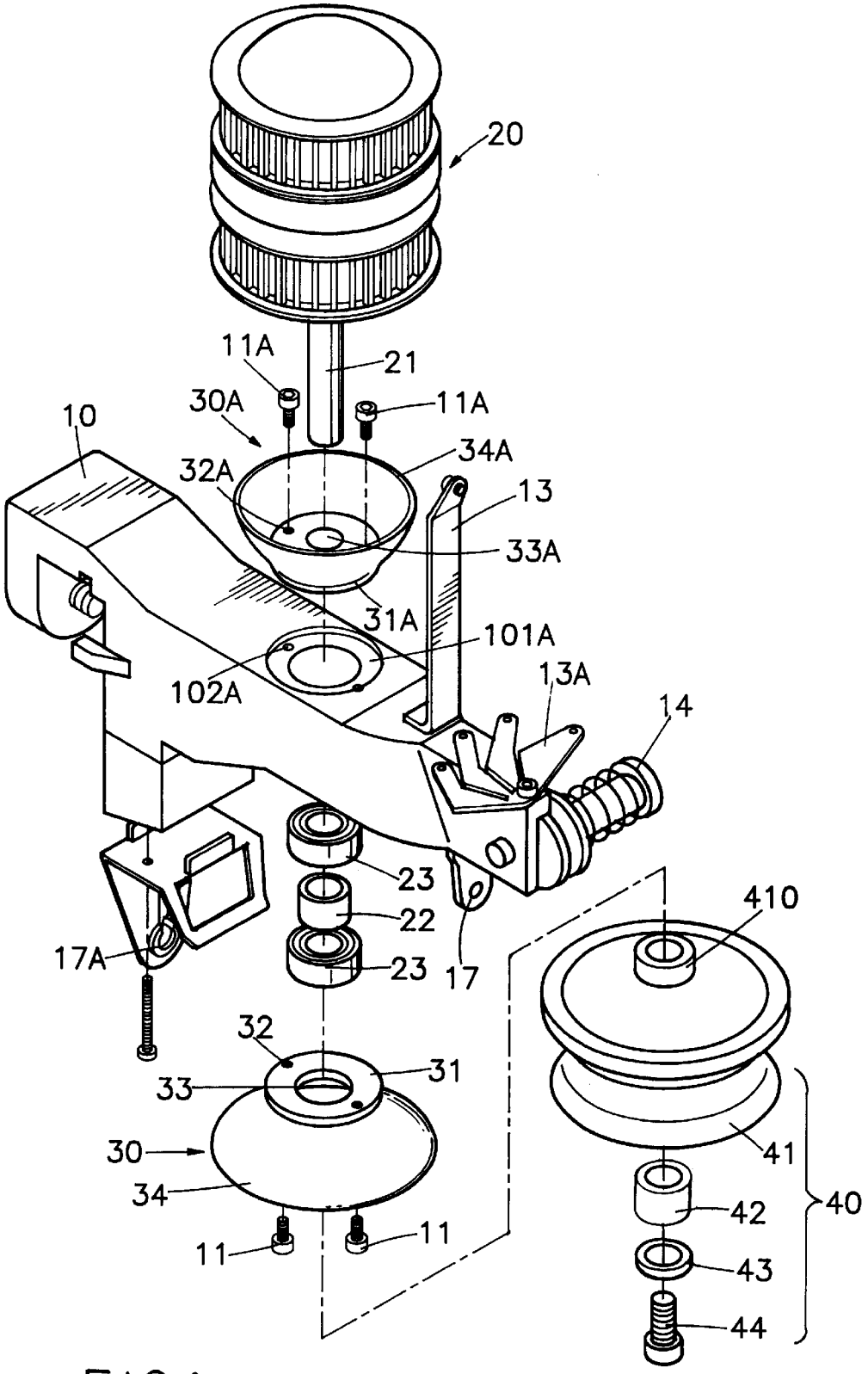
FIG. 1 is a perspective view of a thread feeder which is provided with a thread-twisting preventive device according to the present invention.

Referring to FIG. 1, there is shown a thread feeder on a knitting machine which is provided with the thread-twisting preventive device according to the present invention. The thread feeder is composed of a frame body 10, a pulley set 20, a number of thread guiding devices 13, 13A, 17, 17A, a pair of stop motion devices 16, 16A, a brake wheel 14, and a thread feeding wheel 40. The pulley set 20 has a main axis 21 which penetrates through the frame body 10 to be coupled to a sleeve 22 and a pair of bearings 23 on the other side of the frame body 10. This allows the pulley set 20 to be rotatable on the frame body 10. Further, the thread feeding wheel 40 includes a wheel body 41 which is axially coupled to the bottom end of the main axis 21 by means of a sleeve 42, a washer 43, and a screw 44. The thread feeding wheel 40 is driven by the pulley set 20.

In this embodiment, the thread-twisting preventive device of the invention basically includes a protective piece 30, which is mounted between the bottom portion of the frame body 10 to protect the exposed portions of the spinning main axis 21 above the thread feeding wheel 40.

The bottom protective piece 30 is mounted between the thread feeding wheel 40 and the bottom side of the frame body 10, having its open end facing down. The bottom protective piece 30 has a flat portion 31 formed with a pair of small holes 32 therein which allow a pair of screws 11 to be fastened therethrough to allow the bottom protective piece 30 to be secured tightly to the bottom side of the frame body 10. Moreover, the bottom protective piece 30 is formed with a large hole 33 which is greater in diameter than the central hole of the bearing 23 and the sleeve 410 on the wheel body 41 of the thread feeding wheel 40. When the thread feeding wheel 40 is mounted in position by the screw 44, the sleeve 410, the bearing 23, and the flat portion 31 of the bottom protective piece 30 are coupled axially at the same point on the main axis 21.

In a similar manner, if necessary, the top protective piece 30A may be further mounted between the pulley set 20 and the top of the frame body 10, having its open end facing up. The top protective piece 30A has a flat portion 31A formed with a pair of small holes 32A therein which allow a pair of screws 11A to be fastened therethrough to allow the top protective piece 30A to be secured tightly in position to the top side of the frame body 10. Moreover, the top protective piece 30A is formed with a large hole 33A which is greater in diameter than the central hole of the bearing 23 so that the flat portion 31A can be fixed on the top side of said frame body 10 without rotation together with the main axis 21. These two protective pieces 30, 30A are each cup-like shaped as illustrated in FIG. 1.

The flat portions 31, 31A of the two protective pieces 30, 30A are each formed with a small height, and correspondingly, the top and bottom sides of the frame body 10 are each formed with a recessed portion (only the one of them formed on the top side is illustrated in FIG. 1, which is labeled with the reference numeral 101A) for receiving the flat portions 31, 31A of the two protective pieces 30, 30A therein when the either one of or two protective pieces 30, 30A are to be mounted in position on the frame body 10.

Figure 2:
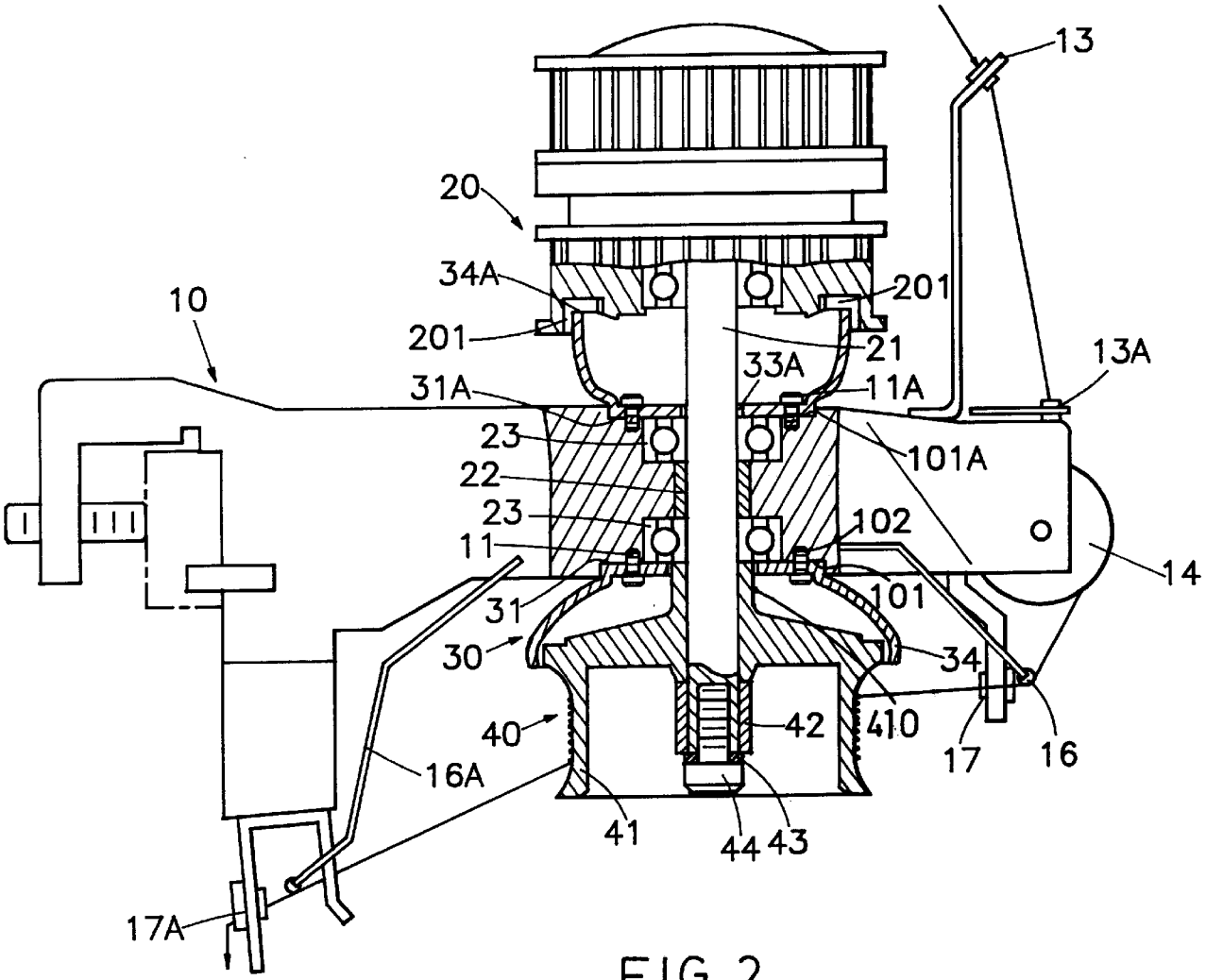
FIG. 2 is a sectional view of the thread feeder of FIG. 1.
Figure 3:
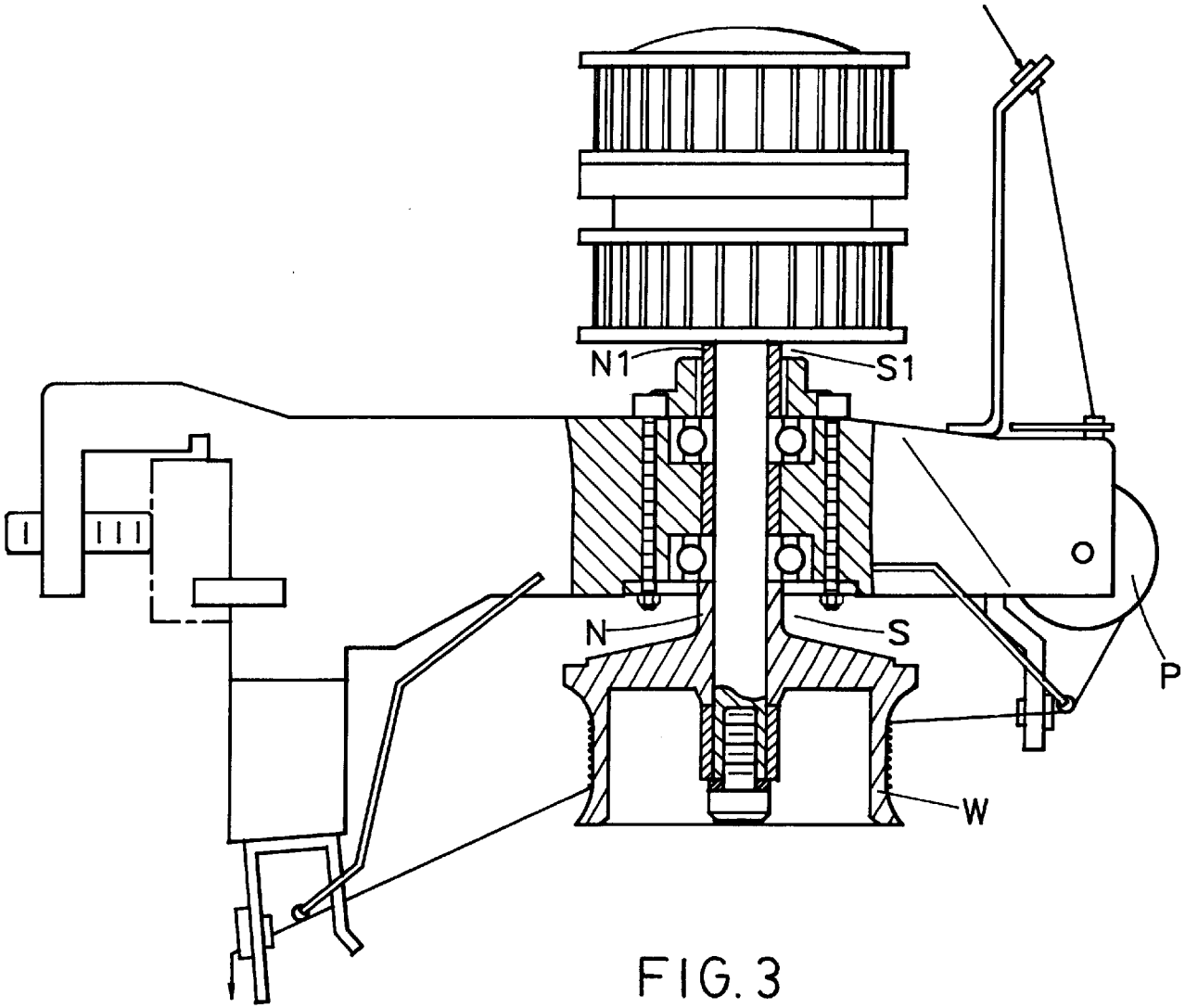
FIG. 3 is a sectional view of a conventional thread feeder.

As clearly illustrated in FIG. 2, the bottom protective piece 30 has its open end entirely covering the top end of the thread feeding wheel 40, such that the wall 34 thereof surrounds all the exposed portion of the spinning main axis 21 above the thread feeding wheel 40; and/or on the top side, the top protective piece 30A has the edge of its open end inserted in a circular slot 201 formed on the bottom of the pulley set 20, substantially covering the bottom end of the pulley set 20, such that the wall 34A thereof surrounds all the exposed portion of the spinning main axis 21 below the pulley set 20.

Since the two protective pieces 30, 30A are fixed pieces without rotation that cover the exposed moving parts of the spinning main axis 21, broken threads will not be pulled by the spinning main axis 21 and twisted around the same. However, in same circumstance, if an additional sleeve is further enveloped on the spinning axis, and the outer surface of the spinning axis is no more rotating at all, and no thread will be twisted around the spinning axis so that the protective piece 30A can be omitted. It means that in some thread feeder, the protective piece 30A is not necessary.

Essentially, the protective pieces are used to mount on any rotating exposed part of the spinning axis or any moving part of the thread feeder so that once the thread breaks off, it will not be pulled by and twisted around these spinning or moving parts of the thread feeder. With the invention, production of fabrics by the knitting machine thus will not be delayed due to broken threads twisting around spinning parts of the thread feeder as in the prior art.

The invention has been described using exemplary preferred embodiments. However, it is to be understood that the scope of the invention is not limited to the disclosed embodiments. To the contrary, it is intended to cover various modifications and similar arrangements. The scope of the claims, therefore, should be accorded the broadest interpretation so as to encompass all such modifications and similar arrangements.

I claim:

1. A thread feeder having a frame body, a pulley set, and a thread feeding wheel rotatably coupled to said frame body by a rotatable axle and comprising a thread-twisting preventive device provided between an upper portion of said thread feeding wheel and a lower portion of said frame body, wherein said thread-twisting preventive device is substantially cup-shaped having a wall and a coupling hole through which the rotatable axle passes, the preventive device fixedly attached to the frame body so as to position the wall to circumferentially cover the rotatable axle and a top of said thread feeding wheel to prevent a broken thread twisting on said rotatable axle and the top of said thread feeding wheel.

2. The thread feeder of claim 1, further comprising a second thread-twisting preventive device fixedly attached to the frame body and located between a lower portion of said pulley set and an upper portion of said frame body.

3. The thread feeder of claim 1, wherein the frame body is formed with a recess and wherein the preventive device has a flat portion with the coupling hole therethrough, the flat portion being mounted in said recess in the frame body.

* * * * *